US011300895B2

(12) United States Patent
Nagamori et al.

(10) Patent No.: US 11,300,895 B2
(45) Date of Patent: Apr. 12, 2022

(54) DISCHARGER AND IMAGE FORMING APPARATUS

(71) Applicant: FUJIFILM Business Innovation Corp., Tokyo (JP)

(72) Inventors: Yuki Nagamori, Kanagawa (JP); Go Miura, Kanagawa (JP)

(73) Assignee: FUJIFILM Business Innovation Corn., Tokyo (JP)

( * ) Notice: Subject to any disclaimer, the term of this patent is extended or adjusted under 35 U.S.C. 154(b) by 0 days.

(21) Appl. No.: 16/919,682

(22) Filed: Jul. 2, 2020

(65) Prior Publication Data

US 2021/0294239 A1 Sep. 23, 2021

(30) Foreign Application Priority Data

Mar. 23, 2020 (JP) ..... JP2020-050847

(51) Int. Cl.
*G03G 15/02* (2006.01)

(52) U.S. Cl.
CPC ..... *G03G 15/0266* (2013.01)

(58) Field of Classification Search
CPC ..... G03G 15/0291; G03G 15/0266
See application file for complete search history.

(56) References Cited

U.S. PATENT DOCUMENTS 8,571,438 B2 * 10/2013 Matsushita ..... G03G 21/1661 399/100
9,042,787 B2 5/2015 Nagamori et al.

FOREIGN PATENT DOCUMENTS

| | | | |
|---|---|---|---|
| JP | 2006-91456 | A | 4/2006 |
| JP | 4123291 | B2 | 7/2008 |
| JP | 4793470 | B2 | 10/2011 |
| JP | 6015091 | B2 | 10/2016 |

* cited by examiner

*Primary Examiner* — Arlene Heredia
(74) *Attorney, Agent, or Firm* — Sughrue Mion, PLLC

(57) ABSTRACT

A discharger includes a first electrode, a second electrode, a tensioning member, a protrusion, and a pressing member. The first electrode extends in a longitudinal direction. The second electrode is disposed between the first electrode and an image carrier member, and includes a netlike portion including multiple openings through which electric charges discharged from the first electrode pass. The tensioning member supports the second electrode while exerting a tension on the second electrode in the longitudinal direction. The protrusion is disposed on the second electrode on an outer side of the netlike portion in the longitudinal direction. The protrusion protrudes beyond the netlike portion in a thickness direction of the second electrode. The pressing member presses the second electrode in the thickness direction. The pressing member is noncontact with the protrusion.

20 Claims, 9 Drawing Sheets

DISCHARGER AND IMAGE FORMING APPARATUS

CROSS-REFERENCE TO RELATED APPLICATIONS

This application is based on and claims priority under 35 USC 119 from Japanese Patent Application No. 2020-050847 filed Mar. 23, 2020.

BACKGROUND

(i) Technical Field

The present disclosure relates to a discharger and an image forming apparatus.

(ii) Related Art

A wide variety of existing electrophotographic image forming apparatuses include a discharger that charges or eliminates static from the surface of an image carrier, transfers a toner image on the image carrier surface to a medium, or discharges electricity from the electrode to eliminate static from the medium. The technology relating to a discharger described in Japanese Patent No. 6015091 ([0083] to [0101] and FIGS. 8 to 13) is known thus far.

Japanese Patent No. 6015091 ([0083] to [0101] and FIGS. 8 to 13) describes a charger (12) that charges a photoconductor drum (11). In the charger 12, short-side outer frames (164 and 165) and attachment frames (166 and 167) of a grid electrode (124) have a thickness (d1) larger than a thickness (d2) of long-side outer frames (161 and 162), a center frame (163), and an opening portion (150). In addition, the thicker short-side outer frames (164 and 165) are attached to curve holding members (126A and 126B) while being bent. Thus, the entirety of the grid electrode (124) including the thin opening portion (150) is bent to follow the shape of the short-side outer frames (164 and 165). Thus, the grid electrode (124) is installed to follow the outer circumference of the photoconductor drum (11).

SUMMARY

Aspects of non-limiting embodiments of the present disclosure relate to reduction of charging failures further than in the case where a netlike electrode has a thick portion at an end portion at which the netlike electrode is to be fixed in position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a discharger that includes a first electrode, a second electrode, a tensioning member, a protrusion, and a pressing member. The first electrode extends in a longitudinal direction. The second electrode is disposed between the first electrode and an image carrier member, and includes a netlike portion including multiple openings through which electric charges discharged from the first electrode pass. The tensioning member supports the second electrode while exerting a tension on the second electrode in the longitudinal direction. The protrusion is disposed on the second electrode on an outer side of the netlike portion in the longitudinal direction. The protrusion protrudes beyond the netlike portion in a thickness direction of the second electrode. The pressing member presses the second electrode in the thickness direction. The pressing member is noncontact with the protrusion.

BRIEF DESCRIPTION OF THE DRAWINGS

Exemplary embodiments of the present disclosure will be described in detail based on the following figures, wherein.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are appropriately omitted for ease of understanding.

EXAMPLE 1

Figure 1:
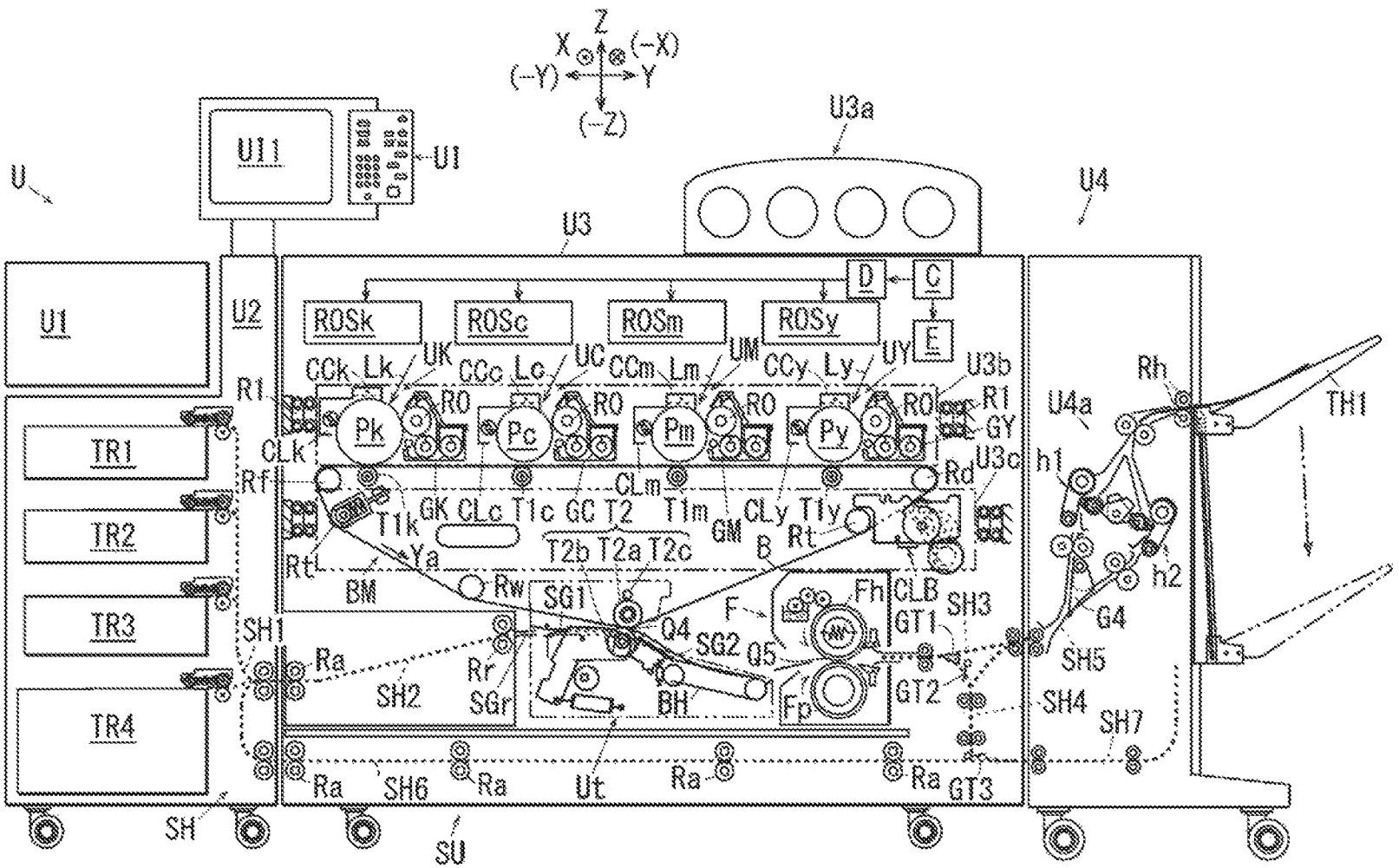
FIG. 1 illustrates the entirety of an image forming apparatus according to an example 1 of the present disclosure.

FIG. 1 illustrates the entirety of an image forming apparatus according to an example 1 of the present disclosure.

In FIG. 1, an image forming apparatus U includes a user interface UI, serving as an example of an operator, an image input device U1, serving as an example of an image reading unit, a feeder device U2, serving as an example of a medium feeder, an image recording device U3, serving as an example of an image forming apparatus body, and a sheet processing device U4, serving as an example of a postprocessor.

The user interface UI includes a display UI1 and input keys such as a copy-start key and numeric keys serving as examples of input members.

The image input device U1 is formed from, for example, an image scanner serving as an example of an image reading device. In FIG. 1, the image input device U1 reads a document, not illustrated, converts the read document into image information, and inputs the information to the image recording device U3.

The feeder device U2 includes sheet feeding trays TR1 to TR4, serving as examples of a member for accommodating multiple media, and a sheet feeding path SH1, along which recording sheets S are transported. The recording sheets S are examples of the media accommodated in the sheet feeding trays TR1 to TR4.

In FIG. 1, the image recording device U3 includes an image recording portion, which records images on the recording sheets S transported from the feeder device U2, a toner dispenser device U3*a*, a sheet transport path SH2, a sheet discharge path SH3, a sheet reversing path SH4, and a sheet circulation path SH6. The image recording portion will be described, later.

The image recording device U3 includes a controller C, serving as an example of a controller, a laser driving circuit D, serving as an example of a driving circuit for a latent-image reading device controlled by the controller C, and a power circuit E, which is controlled by the controller C. The laser driving circuit D outputs laser driving signals corresponding to image information of yellow Y, magenta M, cyan C, and black K input from the image input device U1 to latent-image writing devices ROSy, ROSm, ROSc, and ROSk for the corresponding colors at predetermined timing.

Below the latent-image forming devices ROSy, ROSm, ROSc, and ROSk, serving as examples of latent-image forming members, an image-forming-unit drawer U3*b* is supported by a pair of left and right guide members R1 to be movable between a drawn-out position, where it is drawn to the front side of the image recording device U3, and an attached position, where it is attached to the inside of the image recording device U3.

Figure 2:
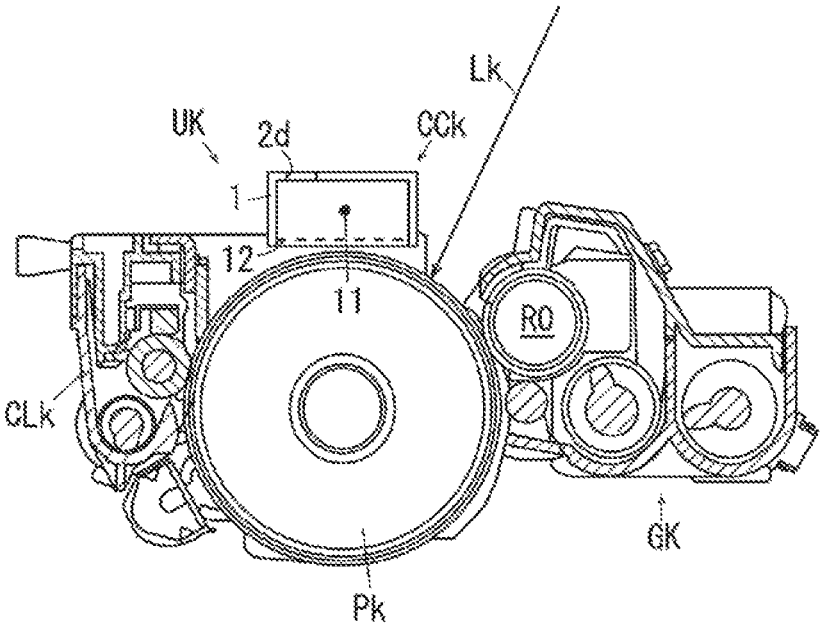
FIG. 2 illustrates a visible-image forming apparatus including an image carrier unit and a developing device.

FIG. 2 illustrates a visible-image forming apparatus including an image carrier unit and a developing device.

In FIGS. 1 and 2, a black image carrier unit UK includes a photoconductor drum Pk, serving as an example of an image carrier member, a charger CCk, serving as an example of a discharger and a charger member, and a photoconductor cleaner CLk, serving as an example of a cleaner for the image carrier member. In the example 1, the charger CCk is formed from a charging unit attachable to and removable from the image recording device U3. Each of image carrier units UY, UM, and UC for other colors of Y, M, and C also includes a photoconductor drum Py, Pm, or Pc, a charger CCy, CCm, or CCc, serving as an example of a discharger, and a photoconductor cleaner CLy, CLm, or CLc. In example 1, the photoconductor drum Pk for the color K, which is used highly frequently and has its surface worn more frequently, has a larger diameter than the photoconductor drums Py, Pm, and Pc for other colors to be prepared for high-speed rotation and to last longer.

The image carrier units UY, UM, UC, and UK and developing devices GY, GM, GC, and GK each including the development roller RO form toner-image forming members UY+GY, UM+GM, UC+GC, and UK+GK. The image carrier units UY, UM, UC, and UK and the developing devices GY, GM, GC, and GK are removably attached to the image-forming-unit drawer U3*b*.

In FIG. 1, the photoconductor drums Py, Pm, Pc, and Pk are charged by the respective chargers CCy, CCm, CCc, and CCk, and then allow electrostatic latent images to be formed on the surfaces by laser beams Ly, Lm, Lc, and Lk, serving as examples of latent-image writing light beams output by the latent-image forming devices ROSy, ROSm, ROSc, and ROSk. The electrostatic latent images on the surfaces of the photoconductor drums Py, Pm, Pc, and Pk are developed by the developing devices GY, GM, GC, and GK, serving as examples of developing members, into toner images of yellow Y, magenta M, cyan C, and black K.

The toner images on the surfaces of the photoconductor drums Py, Pm, Pc, and Pk are sequentially superposed on and transferred to an intermediate transfer belt B, serving as an example of an image carrier member and an intermediate transfer body, by first transfer rollers T1*y*, T1*m*, T1*c*, and T1*k*, serving as examples of first transfer members, so that a multicolor image, that is, a color image is formed on the intermediate transfer belt B. The color image formed on the intermediate transfer belt B is transported to a second transfer area Q4.

In the case of using only black image data, the photoconductor drum Pk and the developing device GK for black are only used to form only a black toner image.

After first transfer, toner remaining on the surfaces of the photoconductor drums Py, Pm, Pc, and Pk is removed by photoconductor cleaners CLy, CLm, CLc, and CLk.

Under the image-forming-unit drawer U3*b*, an intermediate-transfer-body drawer U3*c* is supported to be movable between the drawn-out position, where it is drawn to the front side of the image recording device U3, and the attached position, where it is attached to the inside of the image recording device U3. A belt module BM, serving as an example of an intermediate transfer member, is supported by the intermediate-transfer-body drawer U3*c* to be vertically movable between a raised position, where it is in contact with the lower surfaces of the photoconductor drums Py, Pm, Pc, and Pk, and a lowered position, where it is spaced apart downward from the lower surfaces.

The belt module BM includes the intermediate transfer belt B, a belt driving roller Rd, serving as an example of a driving member, tension rollers Rt, serving as examples of tensioning members, a walking roller Rw, serving as an example of a winding prevention member, multiple idler rollers Rf, serving as examples of driven members, a back-up roller T2*a*, serving as an example of a member opposing the second transfer area Q4, and first transfer rollers T1*y*, T1*m*, T1*c*, and T1*k*. The intermediate transfer belt B is supported by the belt support rollers Rd, Rt, Rw, Rf, and T2*a* to be rotatable in the direction of arrow Ya.

A second transfer unit Ut is disposed below the back-up roller T2*a*. The second transfer unit Ut includes a second transfer roller T2*b*, serving as an example of a second transfer member. The second transfer roller T2*b* is disposed across the intermediate transfer belt B from the back-up roller T2*a* to be spaced apart from and come into contact with the back-up roller T2*a*. The area over which the second transfer roller T2*b* comes into contact with the intermediate transfer belt B forms a second transfer area Q4. A contact roller T2*c*, serving as an example of a voltage application member, is in contact with the back-up roller T2*a*. The rollers T2*a* to T2*c* form a second transfer device T2, serving as an example of a second transfer member.

A second-transfer voltage with a polarity the same as the polarity with which toner is charged is applied to the contact roller T2*c* at a predetermined timing from a power circuit controlled by the controller C.

The sheet transport path SH2 is disposed below the belt module BM. The recording sheets S fed from the sheet feeding path SH1 of the feeder device U2 is transported to the sheet transport path SH2, and transported to the second transfer area Q4 through guide members SGr and SG1, which guide media before transfer, at the right timing when a toner image is transported to the second transfer area Q4 by registration rollers Rr, serving as examples of members that adjust the sheet feeding timing.

The toner image on the intermediate transfer belt B is transferred to the recording sheet S by the second transfer device T2 while passing the second transfer area Q4. In the case of a full-color image, toner images superposed on and first-transferred to the surface of the intermediate transfer belt B are collectively second-transferred to the recording sheet S.

The intermediate transfer belt B after the second transfer is cleaned by a belt cleaner CLB, serving as an example of a cleaning member for the intermediate transfer body.

The first transfer rollers T1*y*, T1*m*, T1*c*, and T1*k*, the intermediate transfer belt B, the second transfer device T2, the belt cleaner CLB, and other components form a transfer device (an example of a transfer member) T1+B+T2+CLB, which transfers images on the surfaces of the photoconductor drums Py to Pk to a recording sheet S.

The recording sheet S to which a toner image is second-transferred is transported to a fixing device F after passing by the medium guide members SG2 after the transfer and the sheet transport belt BH, serving as an example of a medium transport member before fixing. The fixing device F, serving as an example of a fixing member, includes a heat roller Fh, serving as an example of a heating fixing member, and a press roller Fp, serving as an example of a pressing fixing member. The area over which the heat roller Fh and the press roller Fp are in contact with each other forms a fixing area Q5.

The toner image on the recording sheet S is heated and fixed by the fixing device F while passing the fixing area Q5.

The toner-image forming members UY+GY, UM+GM, UC+GC, and UK+GK, the transfer device T1+B+T2+CLB, the fixing device, and other components form an image recording portion according to the example 1 that records images on the recording sheets S.

A first gate GT1, serving as an example of a transport path switching member, is disposed downstream of the fixing device F. The first gate GT1 selectively switches a path for the recording sheet S transported along the sheet transport path SH2 and heated and fixed in the fixing area Q5, between the sheet discharge path SH3 and the sheet reversing path SH4 of the sheet processing device U4. The recording sheet S transported to the sheet discharge path SH3 is transported to the sheet transport path SH5 of the sheet processing device U4.

A curl correction device U4*a*, serving as an example of a bending correction member, is disposed at a portion on the sheet transport path SH5. A second gate G4, serving as an example of a transport path switching member, is disposed on the sheet transport path SH5. The second gate G4 transports the recording sheet S transported from the sheet discharge path SH3 of the image recording device U3 to either a first curl correction member h1 or a second curl correction member h2 in accordance with the direction of bending, or curling. The recording sheet S transported to the first curl correction member h1 or the second curl correction member h2 has its curl corrected while passing through. The recording sheet S having its curl corrected is discharged to a discharge tray TH1, serving as an example of a discharge portion of the sheet processing device U4, from discharge rollers Rh, serving as examples of discharge members, while having its image receiving surface facing up.

The recording sheet S transported to the sheet reversing path SH4 of the image recording device U3 by the first gate GT1 pushes aside a restriction member that restricts movement in the transport direction and that is formed from an elastic film member, that is, a Mylar gate GT2 to be transported to the sheet reversing path SH4 of the image recording device U3.

A sheet circulation path SH6 and a sheet reversing path SH7 are connected to a downstream end of the sheet reversing path SH4 of the image recording device U3. A Mylar gate GT3 is also disposed at the connection portion. The sheet that has been transported to the sheet reversing path SH4 through the first gate GT1 passes through the Mylar gate GT3, and is then transported to the sheet reversing path SH7 of the sheet processing device U4. For double-sided printing, after the recording sheet S that has been transported along the sheet reversing path SH4 passes the Mylar gate GT3 and is transported to the sheet reversing path SH7, the recording sheet S is transported in the reverse direction, that is, transported backward. Then, movement in the transport direction is restricted by the Mylar gate GT3, and the recording sheet S that is transported backward is transported to the sheet circulation path SH6. The recording sheet S transported to the sheet circulation path SH6 passes the sheet feeding path SH1, and is then transported to the second transfer area Q4, again.

On the other hand, after the recording sheet S transported to the sheet reversing path SH4 is transported backward after its trailing end passes the Mylar gate GT2 and before the trailing end passes the Mylar gate GT3, movement of the recording sheet S in the transport direction is restricted by the Mylar gate GT2, and the recording sheet S is transported to the sheet transport path SH5 while being flipped over. The flipped-over recording sheet S has its curl corrected by the curl correction device U4*a*, and then is discharged to the discharge tray TH1 of the sheet processing device U4 while having its image receiving surface facing down.

Figure 3:
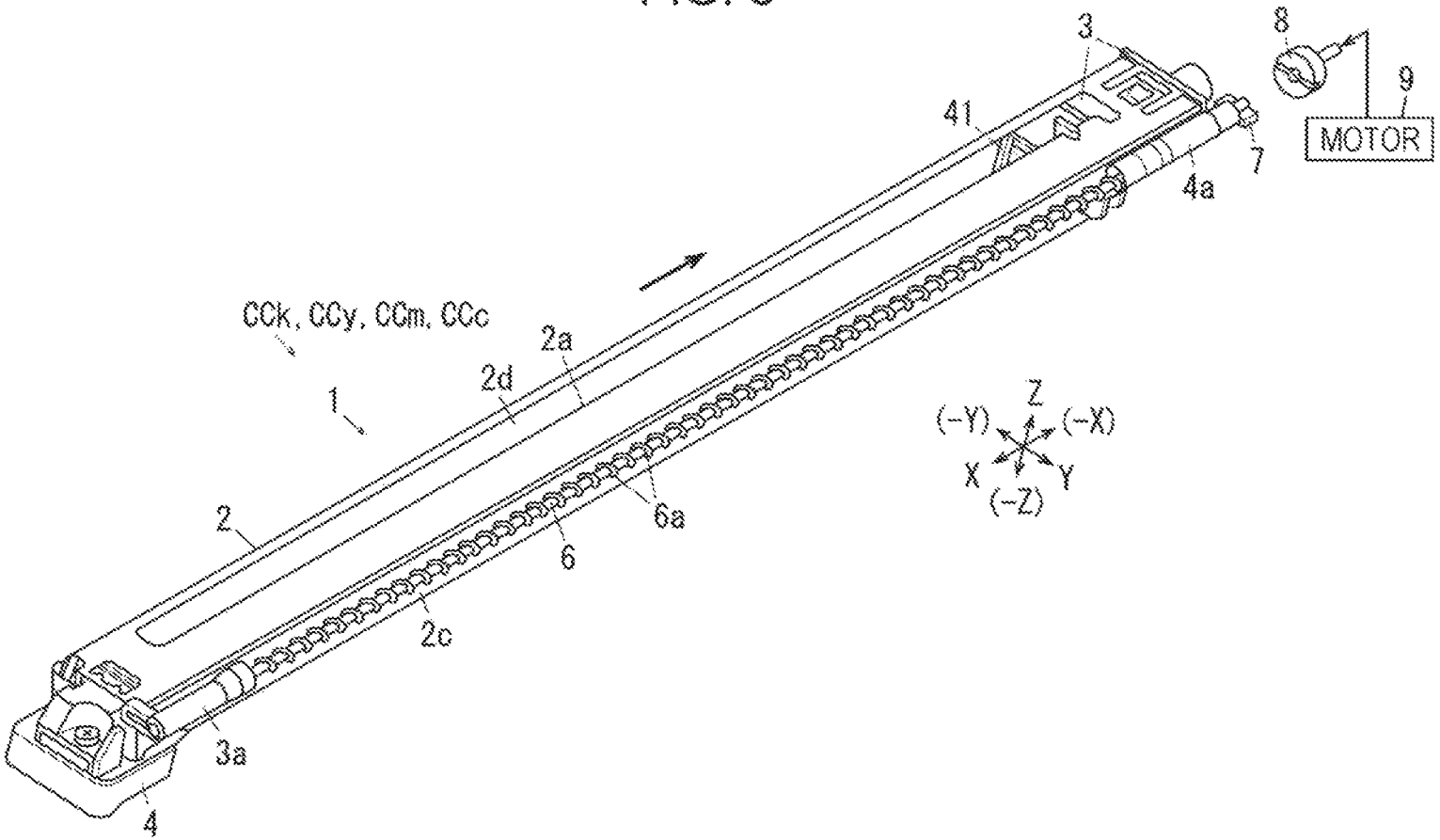
FIG. 3 is a perspective view of a charger according to the example 1 of the present disclosure.

Components denoted with the reference signs SH1 to SH7 form the sheet transport path SH. The components denoted with the reference signs SH, Ra, Rr, Rh, SGr, SG1, SG2, BH, and GT1 to GT3 form a sheet transport device SU. Description on Charger FIG. 3 is a perspective view of a charger according to the example 1 of the present disclosure.

Figure 4:
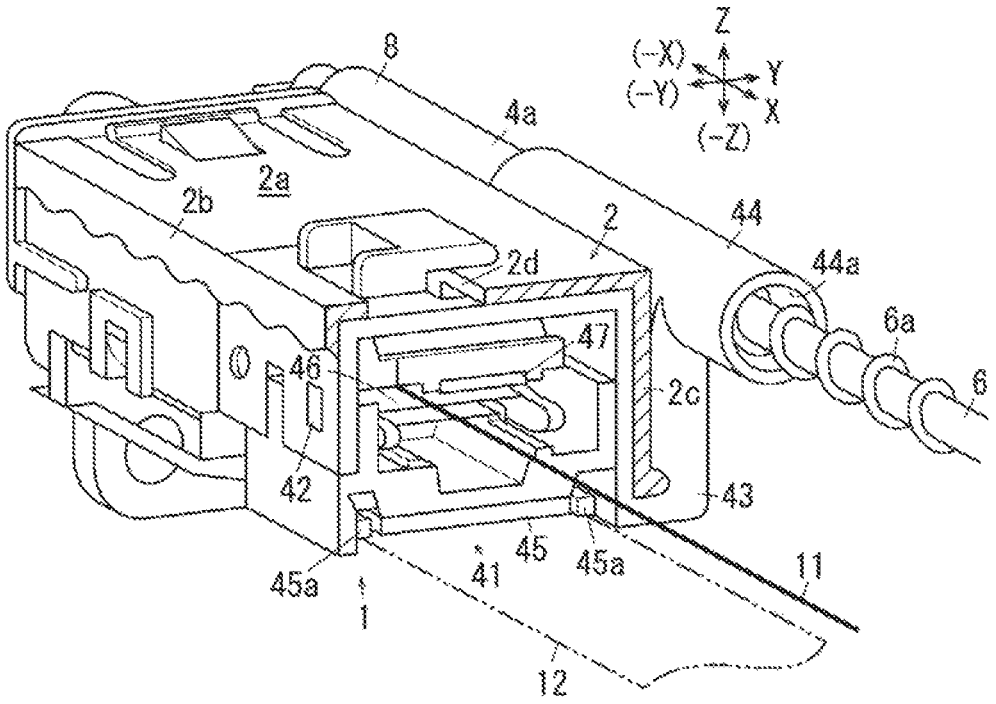
FIG. 4 is a cross-sectional view of a related portion of the charger according to the example 1 of the present disclosure.

FIG. 4 is a cross-sectional view of a related portion of the charger according to the example 1 of the present disclosure.

FIG. 4 does not illustrate part of a shield electrode for ease of understanding the disclosure.

In the following description of the charger according to the example 1, among chargers CCy to CCk for the respective colors Y, M, C, and K, which have the same structure, only a charger CCk for black K will be described in detail without describing the charger CCy to CCc for other colors in detail.

In FIGS. 2, 3, and 4, the charger CCk according to the example 1 includes a charger body 1 extending in the front-rear direction, as an example of a discharger body. The charger body 1 includes a shield electrode 2. The shield electrode 2 is formed from an electroconductive metal material. The shield electrode 2 includes an upper wall 2*a*, which is a plate extending in the front-rear direction, and a left wall 2*b* and a right wall 2*c*, which are plates extending downward from the left and right sides of the upper wall 2*a*. The upper wall 2*a* has, at a left portion, an opening 2*d* extending in the front-rear direction.

A rear-end block 3, serving as an example of a first end member, is supported at the rear end of the shield electrode 2. A front-end block 4, serving as an example of a second end member, is supported at the front end of the shield electrode 2. Cylindrical shaft receivers 3*a* and 4*a* extending in the front-rear direction and serving as examples of supporters for a cleaning moving member, are disposed at the upper right portions of the front-end and rear-end blocks 3 and 4.

A shaft 6, extending in the front-rear direction and serving as an example of a rotation member, is rotatably supported by the shaft receivers 3*a* and 4*a*. The shaft 6 has a thread 6*a* formed on the outer circumferential surface. The shaft 6 extends rearward while having the rear end portion extending through the rear shaft receiver 4*a*. A driven coupling 7, serving as an example of a to-be-transmitted member, is supported at the rear end. When the charger CCk is attached to the image recording device U3, the driven coupling 7 is supported by the image recording device U3 while being engaged with a driving coupling 8, serving as an example of a rotatably supported transmitting member. Driving power from a motor 9 for the electrode cleaner that is supported by the image recording device U3 and that is capable of rotating forward and rearward is transmittable to the driving coupling 8. The motor 9 is an example of a driving source of an electrode cleaning member.

In FIG. 2 to FIG. 4, a wire electrode 11, serving as an example of a first electrode, is disposed in the charger body 1. The wire electrode 11 according to the example 1 is formed from a wire extending in the front-rear direction. The wire electrode 11 has front and rear ends supported by the blocks 3 and 4. A grid electrode 12, serving as an example of a second electrode, is supported in a lower open portion of the shield electrode 2 and between the wire electrode 11 and the photoconductor drum Pk, that is, in a charging area opposing the photoconductor drum Pk.

Description of Grid Electrode

Figure 5:
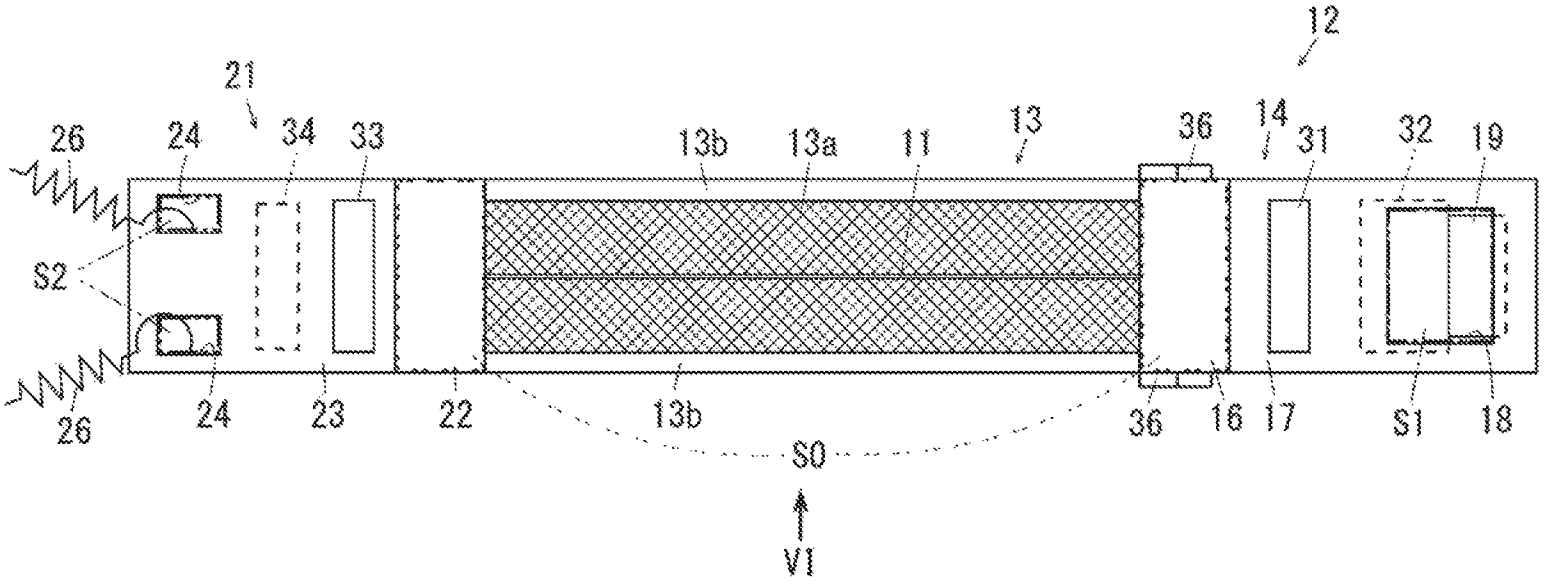
FIG. 5 illustrates a grid electrode according to the example 1.

FIG. 5 illustrates a grid electrode according to the example 1.

Figure 6:
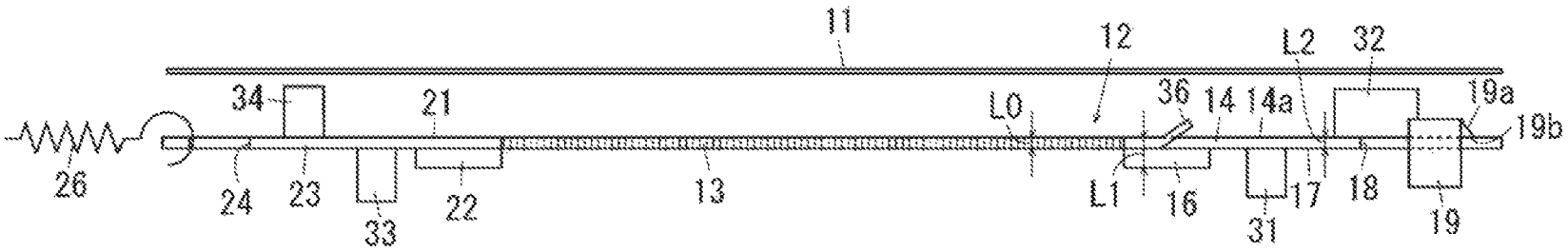
FIG. 6 is a view viewed in the direction of arrow VI in FIG. 5.

FIG. 6 is a view viewed in the direction of arrow VI in FIG. 5.

In FIGS. 5 and 6, the grid electrode 12 according to the example 1 includes a netlike portion 13, extending in the longitudinal direction (photoconductor axis direction). The netlike portion 13 has a netlike shape including multiple first openings 13*a*, and includes hems 13*b* at both ends in the widthwise direction (photoconductor rotation direction).

A first outer frame 14 is disposed at a rear end portion of the netlike portion 13, serving as an example of a first end portion in the longitudinal direction. The first outer frame 14 includes a first thick frame 16, serving as an example of a protrusion. The first thick frame 16 is disposed adjacent to and at the rear of the netlike portion 13. A thickness L1 of the sum of the thickness of the first outer frame 14 and the first thick frame 16 is greater than a thickness L0 of the netlike portion 13. Thus, the portion including the first thick frame 16 has higher rigidity than the netlike portion 13. The first thick frame 16 according to the example 1 is disposed on the lower surface of the first outer frame 14. An upper surface 14*a* of the first outer frame 14 is flush with the upper surface of the netlike portion 13.

In the example 1, the first thick frame 16 is formed by etching on the lower surface of the first outer frame 14, which has the same thickness as the netlike portion 13. Instead of etching, the first thick frame 16 may be formed by another method, for example, by bonding a thin plate or film member with an adhesive or double-sided tape. In the case where the first thick frame 16 is formed by bonding, the thickness or area of the first thick frame 16 is easily adjustable by changing the thickness or area of the component to be bonded. Preferably, the material to be etched, the material to be bonded, or adhesives are the same as those of the netlike portion 13. However, other materials (such as an insulating materials) may be used in accordance with the entire electric characteristics, workability, manufacturing costs, or other factors.

The first outer frame 14 includes a first positioning portion 17, serving as an example of a positioning portion, on the outer side of the first thick frame 16 in the longitudinal direction. The first positioning portion 17 has a thickness L2, which is equivalent to the thickness L0 of the netlike portion 13, that is, L2=L0. Thus, the upper surface and the lower surface of the first positioning portion 17 are on the extensions of the upper surface and the lower surface of the netlike portion 13, that is, aligned with the upper surface and the lower surface of the netlike portion 13.

The first outer frame 14 has a first support port 18, serving as an example of a second opening, on the outer side of the first positioning portion 17. In the example 1, an opening area S1 of the first support port 18 is smaller than an area SO of the first thick frame 16. While a support hook 19, serving as an example of a stretching portion disposed on the rear-end block 3, extends through and is hooked on the first support port 18, the rear end portion of the grid electrode 12 is supported on the rear-end block 3.

In the support hook 19 according to the example 1, a lower surface 19*b* of a hook portion 19*a* that is in contact with the upper surface of the first outer frame 14 has a shape that extends in the direction parallel to the upper surface of the first outer frame 14. Desirably, the lower surface 19*b* is inclined upward, that is, has a shape like "a barb" of a fishing hook to prevent the support hook 19 from falling from the first outer frame 14. However, when the lower surface 19*b* has a "barb" like shape, the first outer frame 14 is more likely to be distorted with a receipt of force of deforming obliquely upward. In this case, a spring 26, described later, would also be inclined with respect to the pulling direction (horizontal direction), and the grid electrode 12 would be more likely to be distorted. Thus, as in the example 1, the lower surface 19*b* has a shape extending in the direction parallel to the upper surface of the first outer frame 14 to prevent distortion of the grid electrode 12.

A second outer frame 21 is disposed at a front end portion of the netlike portion 13, serving as an example of a second end portion in the longitudinal direction. The second outer frame 21 includes a second thick frame 22, serving as an example of a protrusion. The second thick frame 22 according to the example 1 has the same structure as the first thick frame 16 except being disposed symmetric in the front-rear direction with respect to the netlike portion 13, and is thus not described in detail.

The second outer frame 21 includes a second positioning portion 23, serving as an example of a positioning portion, on the outer side of the second thick frame 22 in the longitudinal direction. The second positioning portion 23 has the same structure as the first positioning portion 17 except being disposed symmetric in the front-rear direction with respect to the netlike portion 13, and is thus not described in detail.

The second outer frame 21 includes second support ports 24, serving as examples of urging receiving portions and second openings, on the outer side of the second positioning portion 23. The second support ports 24 according to the example 1 are disposed one at each of opposing sides in the widthwise direction of the grid electrode 12. In the example 1, each of the opening areas S2 of the second support ports 24 is smaller than each the areas S0 of the thick frames 16 and 22, and the sum of the opening areas S2 of the two second support ports 24(=2×S2) is smaller than the area S0 of each of the thick frames 16 and 22.

In FIG. 5, each of the second support ports 24 supports a first end of a spring 26, serving as an example of an urging member. A second end of each spring 26 is supported by the front-end block 4. The springs 26 exert to the grid electrode 12 a force of pulling the grid electrode 12 outward in the longitudinal direction and outward in the widthwise direction through the second support ports 24. As illustrated in FIG. 6, in the example 1, the springs 26 pull the grid electrode 12 in the direction parallel to the surface of the grid electrode 12 (direction perpendicular to the thickness direction).

Thus, the support hook 19 and the springs 26 form a tensioning member, or tensioner, 19+26 according to the example 1, which supports the grid electrode 12 while exerting tension on the grid electrode 12 in the longitudinal direction.

In FIGS. 5 and 6, positioning blocks 31 to 34, serving as examples of pressing members, or pressing blocks, are disposed corresponding to positioning portions 17 and 23 of the grid electrode 12. Specifically, the first lower positioning block 31 is disposed corresponding to the lower surface of the first positioning portion 17, and a first upper positioning block 32 is disposed corresponding to the upper surface of the first positioning portion 17. A second lower positioning block 33 is disposed corresponding to the lower surface of the second positioning portion 23, and the second upper positioning block 34 is disposed corresponding to the upper surface of the second positioning portion 23. The first lower positioning block 31 and the first upper positioning block 32 are shifted from each other in the longitudinal direction. In the example 1, the first lower positioning block 31 is disposed on the inner side in the longitudinal direction. Similarly, the second lower positioning block 33 and the second upper positioning block 34 are shifted from each other in the longitudinal direction. In the example 1, the second lower positioning block 33 is disposed on the inner side in the longitudinal direction.

The positioning blocks 31 to 34 are in contact with the surfaces of the positioning portions 17 and 23 to press the positioning portions 17 and 23 while the grid electrode 12 is under tension. Thus, the positioning blocks 31 to 34 fix the position of the grid electrode 12 in the thickness direction. The positioning blocks 31 to 34 according to the example 1 are shifted from the thick frames 16 and 22 in the longitudinal direction without being in contact with each other.

In FIGS. 5 and 6, guide slopes 36, serving as examples of guide members, are disposed on both outer sides of the first thick frame 16 in the widthwise direction. The guide slopes 36 are inclined toward the netlike portion 13 as they extend further inward in the longitudinal direction. In the example 1, the first thick frame 16 extends to the outer side beyond the guide slopes 36 in the longitudinal direction of the grid electrode 12.

A discharging voltage is applied to the charger CCk according to the example 1 from the power circuit E to the electrodes 2, 11, and 12. Due to a potential difference between the wire electrode 11, the shield electrode 2, and the grid electrode 12, electrons discharged from the wire electrode 11 fall on the photoconductor drum Pk through the first openings 13*a* to charge the surface of the photoconductor drum Pk. In the example 1, a high voltage is applied to the wire electrode 11 to apply, to the grid electrode 12, a voltage corresponding to an intended charging voltage on the surface of the photoconductor drum Pk. The voltage applied to the grid electrode 12 controls discharge of the wire electrode 11, and controls the charging voltage on the surface of the photoconductor drum Pk.

In FIG. 4, an electrode cleaner 41, serving as an example of a member for cleaning a discharger, is disposed in the charger body 1. The electrode cleaner 41 includes a slider frame 42, serving as an example of a cleaning frame. The slider frame 42 according to the example 1 is formed from an insulating material. The slider frame 42 is movable inside the charger body 1 in the longitudinal direction of the charger CCk (in the axial direction of the photoconductor drum Pk).

An arm 43, serving as an example of a coupling portion, is disposed at the lower right end of the slider frame 42. The arm 43 has a letter U shape to cover the lower end of the right wall 2*c* of the shield electrode 2.

A shaft sleeve 44, serving as an example of a linkage portion, is disposed at the upper end of the arm 43. The shaft 6 extends through the inside of the shaft sleeve 44. The shaft sleeve 44 has a thread 44*a*, which is engaged with the thread 6*a* of the shaft 6, inside the shaft sleeve 44. Thus, when the shaft 6 is rotated forward or rearward, the arm 43 is movable in the front-rear direction along the shaft 6 via the threads 6*a* and 44*a*. Specifically, the electrode cleaner 41 is movable in the front-rear direction.

The shaft 6, the arm 43, the shaft sleeve 44, and other components form a movable cleaner 6+43+44 according to the example 1.

A grid cleaner 45, serving as an example of a cleaning member, is supported on the lower surface of the slider frame 42. The grid cleaner 45 is disposed to face the entirety of the netlike portion 13 in the widthwise direction. To-be-guided members 45*a* are disposed on both sides of the grid cleaner 45 in the widthwise direction of the grid electrode 12. The to-be-guided members 45*a* are disposed at positions corresponding to the guide slopes 36.

Thus, when the electrode cleaner 41 reciprocates in the front-rear direction, the grid cleaner 45 comes into contact with the grid electrode 12 to clean the grid electrode 12. When the electrode cleaner 41 moves to the stand-by position of the grid electrode 12 near the rear end in the longitudinal direction, the to-be-guided members 45*a* are guided by the guide slopes 36, and the grid cleaner 45 is spaced apart from the grid electrode 12.

Wire cleaners 46 and 47, serving as examples of cleaning members, are supported on the slider frame 42. The wire cleaners 46 and 47 are disposed below and above the wire electrode 11. The wire cleaners 46 and 47 are spaced apart from the wire electrode 11 when the electrode cleaner 41 is in the stand-by position near the rear end, and the wire cleaners 46 and 47 come into contact with the wire electrode 11 from below and above to clean the wire electrode 11 when the electrode cleaner 41 moves forward.

The grid cleaner 45 according to the example 1 has a so-called brush shape, formed by planting cleaning hair in a foundation cloth. Besides, the grid cleaner 45 may be formed in a cloth form or any other form capable of cleaning. Examples of the grid cleaner 45 or the wire cleaners 46 and 47 are described in, for example, Japanese Patent Application Publication No. 2006-91456. Other existing structures known thus far are employable, which will not be described in detail here.

Operation of Example 1

The image forming apparatus U according to the example 1 according to the disclosure having the above structure includes the grid electrode 12 to serve as a charger CCk. When the grid electrode 12 is thick, electrons discharged from the wire electrode 11 generally come into contact with the grid electrode 12 to be less likely to arrive at the photoconductor drum Pk, so that the discharge efficiency and charging efficiency degrade. Thus, the grid electrode 12 (particularly, the netlike portion 13) is preferably as thin as possible. Thinning of the grid electrode 12 reduces the rigidity of the grid electrode 12. When, for example, matching errors, individual differences, or assembly errors of the grid electrode 12 cause variation in stretching force in the longitudinal direction, the grid electrode 12 may be distorted or twisted. When the grid electrode 12 is distorted, the distance between the grid electrode 12 and the photoconductor drum Pk may be varied, which causes uneven charging.

In the example 1, when the grid electrode 12 is cleaned by the electrode cleaner 41, the grid cleaner 45 spaced apart from the grid electrode 12 comes into contact with the grid electrode 12. Thus, the grid electrode 12 is pressed by the grid cleaner 45. If the grid electrode 12 has, for example, slight distortion, the grid electrode 12 would be extended when being touched by the grid cleaner 45. After spaced apart from the grid cleaner 45, the grid electrode 12 would be distorted again. Every time the grid electrode 12 is cleaned, the grid electrode 12 would be repeatedly bent and extended, and may be worn and broken.

As described in Japanese Patent No. 6015091, the grid electrode improves its rigidity by increasing the thickness of both end portions of the grid electrode. However, when a positioning member is brought into contact with the thick portions to fix the position of the grid electrode, that is, to keep the distance from the grid electrode to the photoconductor drum Pk at an intended distance, the thick portions with which the positioning member is in contact may be misaligned with the thin netlike portion that is supposed to keep the distance from itself and the photoconductor drum Pk. In this case, the difference in thickness between the thick portions and the netlike portion is more likely to have errors, the accuracy in distance between the photoconductor and the grid electrode may degrade, and charging failures may occur.

In contrast, in the example 1, the thick frames 16 and 22 are disposed at both end portions of the grid electrode 12, and the positioning blocks 31 to 34 come into contact with the positioning portions 17 and 23, which are shifted from the thick frames 16 and 22. Thus, the grid electrode 12, which is thin, has high rigidity, and is prevented from being distorted or twisted. In addition, the positioning portions 17 and 23 are used for positioning instead of the thick frames 16 and 22 having the surfaces positioned differently from the netlike portion 13, so that the accuracy in distance between the photoconductor drum Pk and the grid electrode 12 is improvable. The example 1 thus reduces charging failures compared to the case of Japanese Patent No. 6015091.

Particularly, in the example 1, the positioning portions 17 and 23 are disposed to be flush with the surface of the netlike portion 13, that is, the positioning portions 17 and 23 coincide with the surface of the netlike portion 13 in the thickness direction. Thus, the positions at which the positioning portions 17 and 23 are fixed correspond to the position of the netlike portion 13. Thus, the accuracy of the position of the netlike portion 13 is easily improvable.

In the example 1, the positioning portions 17 and 23 are arranged on the outer side of the netlike portion 13 and shifted from the thick frames 16 and 22. Thus, the netlike portion 13 is positioned without blocking the positioning blocks 31 to 34.

In the example 1, the first lower positioning block 31 and the second lower positioning block 33 are disposed on the inner side in the longitudinal direction, and the first upper positioning block 32 and the second upper positioning block 34 are disposed on the outer side in the longitudinal direction. When the upper positioning blocks 32 and 34 are disposed on the inner side of the lower positioning blocks 31 and 33 in the longitudinal direction, the electrode cleaner 41 is more likely to interfere with the upper positioning blocks 32 and 34 when moving to the stand-by position. If the upper positioning blocks 32 and 34 are disposed on the outer side of the electrode cleaner 41, the full length of the charger CCk in the front-rear direction is increased. The example 1 has no such inconvenience.

To determine the distance between the photoconductor drum Pk and the grid electrode 12, only the lower positioning blocks 31 and 33 may be used without using the upper positioning blocks 32 and 34. However, the grid electrode 12 may cause self-excited vibrations during discharge from the wire electrode 11, and the grid electrode 12 may also move toward the upper surface with the self-excited vibrations. In contrast, in the example 1, the grid electrode 12 has its upper surface and its lower surface fixed in position by the positioning blocks 31 to 34. Thus, the distance between the photoconductor drum Pk and the grid electrode 12 is more likely to be kept even with the occurrence of self-excited vibrations.

The upper positioning blocks 32 and 34 may be respectively aligned with the lower positioning blocks 31 and 33 in the longitudinal direction of the grid electrode 12. However, this alignment may highly likely cause errors during manufacture and assembly, and degrade the positioning accuracy. In contrast, in the example 1, the upper positioning blocks 32 and 34 are misaligned with the lower positioning blocks 31 and 33 in the longitudinal direction, and thus prevent degradation of the positioning accuracy.

In the example 1, the first thick frame 16 extends to the outer side beyond the guide slopes 36 in the longitudinal direction. Specifically, the first thick frame 16 covers the entire area of the guide slopes 36 in the longitudinal direction. The guide slopes 36 are more likely to bear a load during movement of the electrode cleaner 41. When the portion that supports the guide slopes 36 has low rigidity, the grid electrode 12 may be deformed (distorted or twisted) and may be worn and broken. In contrast, in the example 1, the first thick frame 16 that supports the guide slopes 36 is thick, and has higher rigidity than in the case of having the same thickness as the netlike portion 13. The grid electrode 12 is thus prevented from being broken.

When the areas S1 and S2 of the first support port 18 and the second support ports 24 are greater than the areas SO of the thick frames 16 and 22, the entire structure may have insufficient rigidity. However, in the example, the areas S0>the areas S1 and S2. Thus, the insufficiency of rigidity is avoided.

In the example 1, the springs 26 pull the grid electrode 12 outward in the longitudinal direction and the widthwise direction, but this is not the only possible structure. Instead, one spring 26 may pull the grid electrode 12 outward in the longitudinal direction. However, the structure including only one spring 26 is more likely to allow the grid electrode 12 to be distorted. In contrast, in the structure where, as in the example 1, the springs 26 pull the grid electrode 12 outward in the longitudinal direction and the widthwise direction, that is, exert a force of expanding the grid electrode 12, the grid electrode 12 is prevented from being distorted. Similarly, the structure where the springs 26 pull the grid electrode 12 in the direction parallel to the surface of the grid electrode (direction orthogonal to the thickness direction) is not the only possible example. However, when the springs 26 are pulled in the direction not parallel to the surface of the grid electrode 12 (in the direction having a component of the thickness direction), the grid electrode 12 is more likely to be distorted. Thus, in the structure where the springs 26 pull the grid electrode 12 in the direction parallel to the surface of the grid electrode 12 (direction orthogonal to the thickness direction), the grid electrode 12 is more likely to be prevented from being distorted.

EXAMPLE 2

Figure 7:
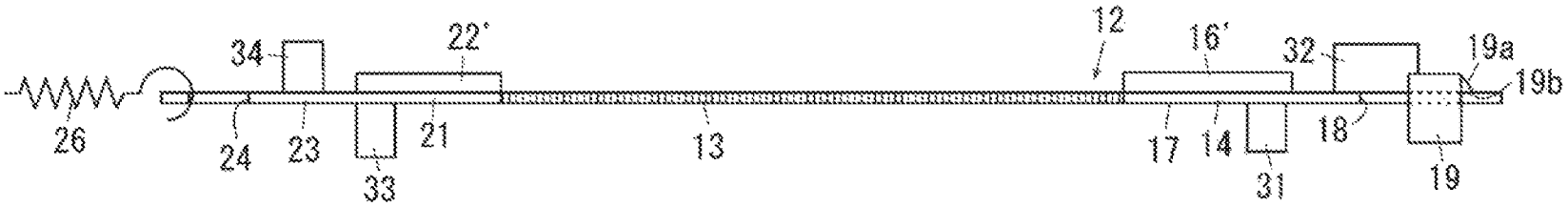
FIG. 7 illustrates a grid electrode according to an example 2, and corresponds to FIG. 6 illustrating the example 1.

FIG. 7 illustrates a grid electrode according to an example 2, and corresponds to FIG. 6 illustrating the example 1.

In the description of the example 2, components corresponding to the components of the example 1 are denoted with the same reference signs without describing them.

The example 2 differs from the example 1 in the following points, and is similar to the example 1 in other points.

In FIG. 7, the grid electrode 12 according to the example 2 includes, instead of the thick frames 16 and 22 according to the example 1, thick frames 16' and 22' disposed on the upper surface of the grid electrode 12 (closer to the wire electrode 11) instead of the lower surface of the grid electrode 12 (closer to the photoconductor drum Pk). The thick frames 16' and 22' according to the example 2 extend in the longitudinal direction to the area opposite to the area over which the lower positioning blocks 31 and 33 are in contact. Thus, in the example 2, the lower positioning blocks 31 and 33 are disposed on the surface of the grid electrode 12 opposite to the thick frames 16' and 22' in the thickness direction.

Operations of Example 2

The charger CCk according to the example 2 including the above structure has higher rigidity than the grid electrode 12 according to the example 1, and the positions where the positioning blocks 31 to 34 are fixed correspond to the upper surface and the lower surface of the netlike portion 13 to fully secure the accuracy.

EXAMPLE 3

Figure 8:
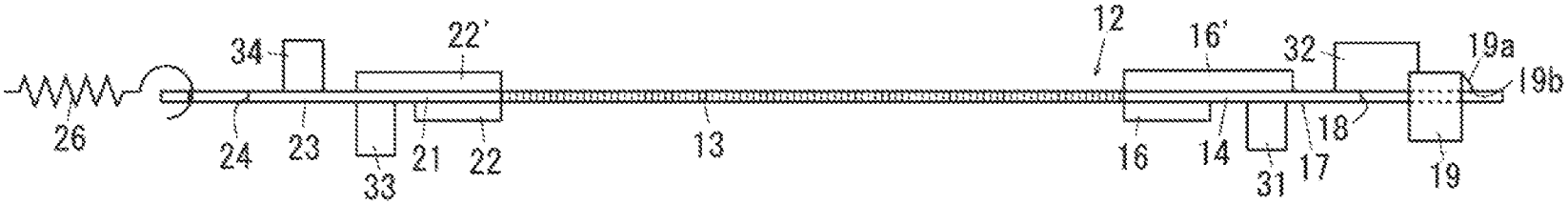
FIG. 8 illustrates a grid electrode according to an example 3, and corresponds to FIG. 6 illustrating the example 1.

FIG. 8 illustrates a grid electrode according to an example 3, and corresponds to FIG. 6 illustrating the example 1.

In the description of the example 3, components corresponding to the components of the examples 1 and 2 are denoted with the same reference signs without describing them.

The example 3 differs from the examples 1 and 2 in the following points, and is similar to the examples 1 and 2 in other points.

In FIG. 8, the grid electrode 12 according to the example 3 includes both the thick frames 16 and 22 according to the example 1 and the thick frames 16' and 22' according to the example 2.

Operations of Example 3

The charger CCk according to the example 3 including the above structure has higher rigidity than the grid electrode 12 according to the example 2, and, as in the case of the examples 1 and 2, the accuracy of the positions of the grid electrode 12 in the thickness direction is fully secured.

EXAMPLE 4

Figure 9:
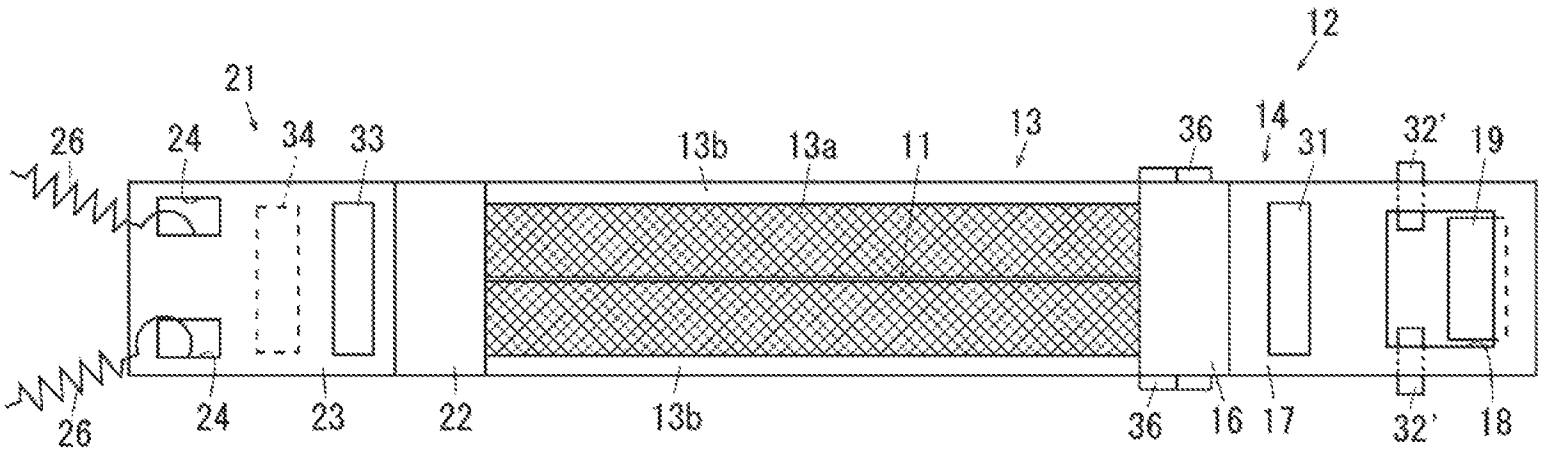
FIG. 9 illustrates a grid electrode according to an example 4, and corresponds to FIG. 5 illustrating the example 1.

FIG. 9 illustrates a grid electrode according to an example 4, and corresponds to FIG. 5 illustrating the example 1.

In the description of the example 4, components corresponding to the components of the example 1 are denoted with the same reference signs without describing them.

The example 4 differs from the example 1 in the following points, and is similar to the example 1 in other points.

In FIG. 9, the charger CCk according to the example 4 differs from that according to the example 1 in that it includes first upper positioning blocks 32', and the grid electrode 12 is fixed in position by bringing the first upper positioning blocks 32' into contact with the edge of the first support port 18 at both ends in the widthwise direction.

Operation of Example 4

In the charger CCk according to the example 4 having the above structure, the first upper positioning blocks 32' fix the position of the upper surface of the grid electrode 12 at both ends in the widthwise direction. Specifically, compared to the structure according to the example 1, the center portion in the widthwise direction is empty. In a structure where, as in the case of the example 1, the first upper positioning block 32 is long in the widthwise direction, the electrode cleaner 41 is more likely to interfere with the first upper positioning block 32 when moving to the stand-by position. In contrast, when, as in the example 4, the first upper positioning blocks 32' are disposed on both ends in the widthwise direction, the space for the electrode cleaner 41 is easily secured, which improves freedom in design of the electrode cleaner 41 and contributes to size reduction as a whole.

MODIFIED EXAMPLES

Thus far, the examples of the present disclosure have been descried in detail. However, the disclosure is not limited to the above-described examples, and may be modified in various manners within the scope of the gist of the present disclosure described in the scope of claims. Modified examples H01 to H014 of the present disclosure are described, below, by way of examples.

H01

In the above examples, the present disclosure is not limited to a copying machine described as an example of an image forming apparatus. The present disclosure is applicable to a printer, a FAX machine, or another image forming apparatus. The image forming apparatus is not limited to a full-color image forming apparatus, and may be a monochrome image forming apparatus. The image forming apparatus is not limited to a tandem image forming apparatus, and may be a rotary image forming apparatus.

H02

The above example has a structure where, by way of example, the wire electrode 11 is formed from a single wire. Instead, the wire electrode 11 may be formed from two or more wires.

H03

The above example may exclude the shield electrode 2.

H04

The above example has a structure where, by way of example, the wire cleaners 46 and 47 are brought into contact with and spaced apart from the wire electrode 11. However, the wire cleaners 46 and 47 may be in contact with the wire electrode 11 all the time. Similarly, the grid cleaner 45 may be in contact with the grid electrode 12 all the time.

H05

The above example has a structure where, by way of example, a charger is used as an example of a discharger. Instead, the photoconductor drums Py to Pk, a static eliminator for the recording sheets S, an auxiliary charger, or the transfer devices T1*y* to T1*k* and T2 may be used as a discharger.

H06

In the above example, the structure for moving the electrode cleaner 41 in the front-rear direction is not limited to the structure including the shaft 6 by way of example. Any structure capable of moving the electrode cleaner 41 in the front-rear direction may be employed.

H07

Instead of the structure of the above example illustrated by way of example, the grid cleaner 45 may have any other structure in accordance with design or other factors. For example, the grid cleaner 45 may have a structure of a brush or a cloth, or any other structure capable of cleaning such as a sponge. In addition, the grid cleaner 45 may include a cleaner portion that comes into contact with the inner peripheral surface of the shield electrode 2 to be capable of cleaning the shield electrode 2, or may include a cleaner that comes into contact with the lower surface of the grid electrode 12 to be capable of cleaning both surfaces of the grid electrode 12.

H08

In the above example, a pair of wire cleaners 46 and 47 are preferably provided on both sides of the wire electrode 11. However, the structure may include only one wire cleaner or three or more wire cleaners. The wire cleaners 46 and 47 are preferably shifted in the longitudinal direction of the wire electrode 11, but may be arranged at the same position.

H09

In the above example, the positioning portions 17 and 23 are preferably flush with the surface of the netlike portion 13. However, the positioning portions 17 and 23 may be shifted from the surface of the netlike portion 13 within the range of allowing for manufacturing tolerance or assembly tolerance.

H010

In the above example, the positioning portions 17 and 23 are preferably disposed on the outer side beyond the thick frames 16 and 22, and/or 16' and 22' in the longitudinal direction, but may be disposed on the inner side. The examples 2 and 3 have a structure including the thick frames 16' and 22' on the side opposite to the lower positioning blocks 31 and 33. However, the thick frames may be disposed on the side opposite to the upper positioning blocks 32 and 34.

H011

In the above example, the guide slopes 36 are preferably disposed, but may be omitted.

H012

In the example 4, only the first upper positioning block 32' is split to be disposed on opposing sides in the widthwise direction. However, the first lower positioning block 31, the second lower positioning block 33, and/or the second upper positioning block 34 may also be split. Each block may be split into three or more, instead of two.

H013

In the above example, the areas S1 and S2 of the support ports 18 and 24 are preferably smaller than the areas S0 of the thick frames 16 and 22. However, S0<S1 or S2 is also acceptable depending on, for example, design, specifications, or the rigidity of the material used.

H014

The above example has a structure where, by way of example, the two springs 26 pull the grid electrode 12 outward in the longitudinal direction and the widthwise direction, but may include three or more springs. The above example has a structure where, by way of example, the rear end of the grid electrode 12 is supported by the support hook 19, but this is not the only possible structure. The rear end may also be supported by a spring.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A discharger, comprising:

a first electrode that extends in a longitudinal direction;

a second electrode disposed between the first electrode and an image carrier member, and including a netlike portion including a plurality of openings through which electric charges discharged from the first electrode pass;

a tensioner that supports the second electrode while exerting a tension on the second electrode in the longitudinal direction;

a protrusion disposed on the second electrode on an outer side of the netlike portion in the longitudinal direction, the protrusion protruding beyond the netlike portion in a thickness direction of the second electrode; and at least one pressing block that presses the second electrode in the thickness direction, the pressing block being noncontact not in contact with the protrusion;

wherein the protrusion is disposed between the netlike portion and the pressing block in the longitudinal direction.

2. The discharger according to claim 1, further comprising:

a positioning portion disposed at a portion corresponding to a surface of the netlike portion in the thickness direction of the second electrode, the pressing block coming into contact with the positioning portion.

3. The discharger according to claim 2, wherein the positioning portion is shifted from the protrusion and disposed on an outer side of the netlike portion in the longitudinal direction.

4. The discharger according to claim 2, wherein the positioning portion is disposed on a surface opposite to the protrusion in the thickness direction of the second electrode.

5. The discharger according to claim 1, further comprising:

an electrode cleaner that cleans the netlike portion while coming into contact with the netlike portion; and a guide slope disposed on the second electrode to guide the electrode cleaner, wherein the protrusion extends outward in the longitudinal direction beyond the guide-slope.

6. The discharger according to claim 2, further comprising:

an electrode cleaner that cleans the netlike portion while coming into contact with the netlike portion; and a guide slope that is disposed on the second electrode to guide the electrode cleaner, wherein the protrusion extends outward in the longitudinal direction beyond the guide slope.

7. The discharger according to claim 3, further comprising:

an electrode cleaner that cleans the netlike portion while coming into contact with the netlike portion; and a guide slope that is disposed on the second electrode to guide the electrode cleaner, wherein the protrusion extends outward in the longitudinal direction beyond the guide slope.

8. The discharger according to claim 4, further comprising:

an electrode cleaner that cleans the netlike portion while coming into contact with the netlike portion; and a guide slope that is disposed on the second electrode to guide the electrode cleaner, wherein the protrusion extends outward in the longitudinal direction beyond the guide slope.

9. The discharger according to claim 1, wherein the protrusion is formed by bonding a component to the second electrode.

10. The discharger according to claim 2, wherein the protrusion is formed by bonding a component to the second electrode.

11. The discharger according to claim 3, wherein the protrusion is formed by bonding a component to the second electrode.

12. The discharger according to claim 4, wherein the protrusion is formed by bonding a component to the second electrode.

13. The discharger according to claim 5, wherein the protrusion is formed by bonding a component to the second electrode.

14. The discharger according to claim 6, wherein the protrusion is formed by bonding a component to the second electrode.

15. The discharger according to claim 1, wherein the at least one pressing block includes pressing blocks disposed on both end portions in a widthwise direction crossing the longitudinal direction and the thickness direction.

16. The discharger according to claim 1, wherein the tensioner is attached to at least one second opening formed on an outer side of the netlike portion in the longitudinal direction, and wherein the second opening has an area smaller than an area of the protrusion.

17. The discharger according to claim 16, wherein the at least one second opening includes a plurality of second openings formed to hold the netlike portion therebetween in the longitudinal direction, and wherein the area of each of the second openings is smaller than the area of the protrusion.

18. The discharger according to claim 1, further comprising:

urging receiving portions disposed at one end portion in the longitudinal direction of the second electrode and at both end portions in a widthwise direction of the second electrode, wherein the tensioner comprises a resilient material that is supported by the urging receiving portions and that exerts a force of pulling the second electrode outward in the longitudinal direction and the widthwise direction of the second electrode.

19. The discharger according to claim 18, wherein the resilient material pulls the second electrode in a direction parallel to a surface of the second electrode.

20. An image forming apparatus, comprising:

an image carrier member; and a charger member formed from the discharger according to claim 1, the charger member charging a surface of the image carrier member.

* * * * *